US011773668B2

(12) United States Patent
Lim et al.

(10) Patent No.: US 11,773,668 B2
(45) Date of Patent: Oct. 3, 2023

(54) RUNNING TOOL SYSTEM FOR A HANGER

(71) Applicant: Cameron International Corporation, Houston, TX (US)

(72) Inventors: Haw Keat Lim, Singapore (SG); Choon Keat Lai, Singapore (SG); Yoon Keat Yong, Singapore (SG); Boon Hao Hee, Singapore (SG); Ping Cheng Lai, Singapore (SG)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 28 days.

(21) Appl. No.: 17/279,987

(22) PCT Filed: Sep. 25, 2019

(86) PCT No.: PCT/US2019/052940
§ 371 (c)(1),
(2) Date: Mar. 25, 2021

(87) PCT Pub. No.: WO2020/068971
PCT Pub. Date: Apr. 2, 2020

(65) Prior Publication Data

US 2021/0396085 A1 Dec. 23, 2021

Related U.S. Application Data

(60) Provisional application No. 62/735,929, filed on Sep. 25, 2018.

(51) Int. Cl.

| | |
|---|---|
| ***E21B 33/04*** | (2006.01) |
| ***E21B 23/01*** | (2006.01) |
| ***E21B 43/10*** | (2006.01) |

(52) U.S. Cl.
CPC ..... *E21B 23/01* (2013.01); *E21B 33/04* (2013.01); *E21B 43/10* (2013.01)

(58) Field of Classification Search
CPC ..... E21B 33/04; E21B 43/10
See application file for complete search history.

(56) References Cited

U.S. PATENT DOCUMENTS 4,488,740 A 12/1984 Baugh et al.
6,092,596 A 7/2000 Van Bilderbeek
(Continued)

OTHER PUBLICATIONS

International Search Report and Written Opinion issued in the PCT application PCT/US2019/052940, dated Jan. 15, 2020 (12 pages).
(Continued)

*Primary Examiner* — Cathleen R Hutchins
*Assistant Examiner* — Ronald R Runyan
(74) *Attorney, Agent, or Firm* — Matthew Goode

(57) ABSTRACT

A technique facilitates utilization of a running tool system for use with a tubing hanger deployed at a wellhead. The running tool system may comprise a running tool which may be coupled to a hanger. The running tool may include a first sleeve which may be coupled to the hanger for moving the hanger in an axial direction. According to an embodiment, the running tool also may include a second sleeve which may be coupled to an adjustable landing ring disposed about the hanger. The second sleeve may be used to rotate the adjustable landing ring so as to lock the hanger in position.

13 Claims, 5 Drawing Sheets

(56) References Cited

U.S. PATENT DOCUMENTS

| | | | |
|---|---|---|---|
| 8,347,970 | B2 | 1/2013 | Vanderford et al. |
| 8,944,156 | B2 | 2/2015 | Keat et al. |
| 2010/0193195 | A1 | 8/2010 | Nguyen et al. |
| 2011/0266006 | A1 | 11/2011 | Lacheny et al. |
| 2012/0305269 | A1 | 12/2012 | Bories et al. |
| 2014/0311753 | A1 | 10/2014 | Hanson et al. |
| 2015/0152695 | A1 | 6/2015 | Vanderford et al. |
| 2015/0285018 | A1 | 10/2015 | Thornburrow et al. |
| 2016/0186523 | A1 | 6/2016 | Nguyen |
| 2017/0058622 | A1 | 3/2017 | Nguyen et al. |
| 2017/0152721 | A1* | 6/2017 | Bories ..... E21B 33/047 |
| 2017/0152978 | A1 | 6/2017 | Leeth et al. |

OTHER PUBLICATIONS

International Preliminary Report on Patentability issued in the PCT application PCT/US2019/052940, dated Apr. 8, 2021 (9 pages).

* cited by examiner

RUNNING TOOL SYSTEM FOR A HANGER

CROSS-REFERENCE TO RELATED APPLICATION

The present document is based on and claims priority to U.S. Provisional Application Ser. No. 62/735,929, filed Sep. 25, 2018, which is incorporated herein by reference in its entirety.

BACKGROUND

To meet demand for natural resources, companies often invest substantial amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of a desired resource. Such systems generally include a wellhead assembly through which the resource is extracted. These wellhead assemblies may include a wide variety of components, e.g. casings, hangers, valves, fluid conduits, that control drilling and/or extraction operations. In some drilling and production systems, casing hangers and other types of tubing hangers may be used to suspend strings (e.g. piping for various flows in and out of the well). Such hangers may be disposed within a housing of a wellhead which supports both the hanger and the string. The hanger may be secured to the wellhead via a locking or mounting mechanism activated by a running tool.

SUMMARY

In general, a system and methodology are provided for utilizing a running tool system with respect to a tubing hanger deployed at a wellhead. According to an embodiment, the running tool system comprises a running tool which may be coupled to a hanger. The running tool may include a first sleeve which may be coupled to the hanger for moving the hanger in an axial direction. The running tool also may include a second sleeve which may be coupled to an adjustable landing ring disposed about the hanger. The second sleeve may be used to rotate the adjustable landing ring so as to lock the hanger in position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Embodiments described herein are directed to a running tool system which may be used to expedite well operations, e.g. drilling operations. As explained in greater detail below, the running tool system enables a running tool to both lower and set a hanger without a separate tool, e.g. without a slipshot sleeve, sliding over the running tool and without running multiple tools. The running tool system described herein may thus be used to run, e.g. deploy, the hanger and/or tubing into a wellbore and to secure, e.g. lock, the hanger within the wellhead in a single trip.

Figure 1:
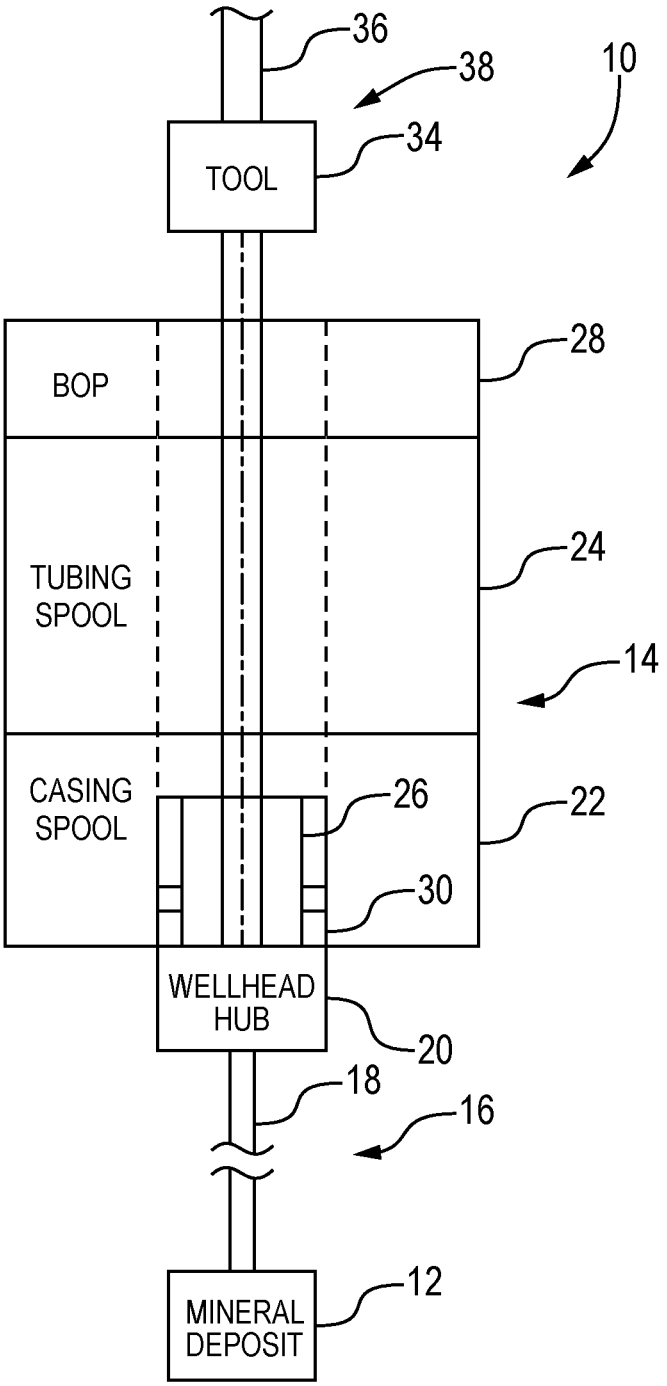
FIG. 1 is a schematic illustration of an example of a mineral extraction system with a running tool, according to an embodiment of the disclosure.

Referring generally to FIG. 1, a schematic illustration is provided of a mineral extraction system 10. The mineral extraction system 10 is configured to extract various natural resources, e.g. hydrocarbons, from a mineral deposit 12. For example, the mineral extraction system 10 may be used to extract oil and/or natural gas from a subterranean reservoir forming mineral deposit 12. Depending on where the natural resource is located, the mineral extraction system 10 may be a surface system, e.g. land-based system, or a subsea system. The illustrated mineral extraction system 10 comprises a wellhead 14 which may be placed in communication with the mineral deposit/reservoir 12 via a well 16 having a wellbore 18. The wellbore 18 extends from the mineral deposit/reservoir 12 to a hub 20 of the wellhead 14 located at or near the surface.

The illustrated wellhead hub 20, which may be a large diameter hub, acts as a junction between the well 16 and the equipment located above the well 16. The wellhead hub 20 may include a complementary connector, e.g. a collet connector, to facilitate connections with the surface equipment. Additionally, the wellhead hub 20 may be constructed to support various strings of casing/tubing that extend into the wellbore 18 and, in some cases, extend down into the mineral deposit 12.

The wellhead 14 generally comprises a series of devices and components which control and regulate activities and conditions associated with the well 16. For example, the wellhead 14 may provide for routing the flow of minerals, e.g. oil and/or gas, produced from the mineral deposit 12 in wellbore 18. Additionally, the wellhead 14 may provide for regulating pressure in the well 16 and/or for the injection of chemicals downhole into the wellbore 18. In the illustrated embodiment, the wellhead 14 includes a housing/casing spool 22, e.g. a tubular housing, and a tubing spool 24. A hanger 26, e.g. a tubing hanger or a casing hanger, may be deployed and set in the casing spool/housing 22. The wellhead 14 also may comprise a blowout preventer (BOP) 28.

In operation, the wellhead 14 enables completion and workover procedures such as tool insertion into well 16 for installation and removal of various components, e.g. hangers, shoulders, and/or other components. Furthermore, oil, gas, and/or other minerals extracted from the well 16 may be regulated and routed via the wellhead 14. According to one example, the blowout preventer 28 may include a variety of valves, fittings, and control features to prevent oil, gas, or other fluid from exiting the well 16 in the event of an unintentional release of pressure or an overpressure condition.

In the illustrated example, the casing spool 22 defines a bore 30, e.g. a casing spool bore, which enables fluid communication between the wellhead 14 and the well 16. Thus, the bore 30 may provide access to the wellbore 18 during various completion and workover procedures including deploying tools or components within the casing spool 22. For example, the illustrated embodiment of mineral extraction system 10 comprises a running tool 34 suspended from a string 36 to form a running tool system 38. The running tool 34 may be moved axially to position hanger 26 and also rotationally to apply torque for installing the hanger 26 in the casing spool 22.

In contrast, a conventional installation of a hanger involves both a running tool and a separate sleeve, e.g. a slipshot sleeve, which slides over the running tool. With conventional systems, the running tool lowers the hanger into the wellhead while the separate sleeve slides over the running tool to contact and set the hanger. As explained in greater detail below, however, the running tool system 38, illustrated in FIGS. 1-5 and described herein, enables the running tool 34 to both lower and set the hanger 26 without a separate tool sliding over the running tool 34 and without running multiple tools.

Figure 2:
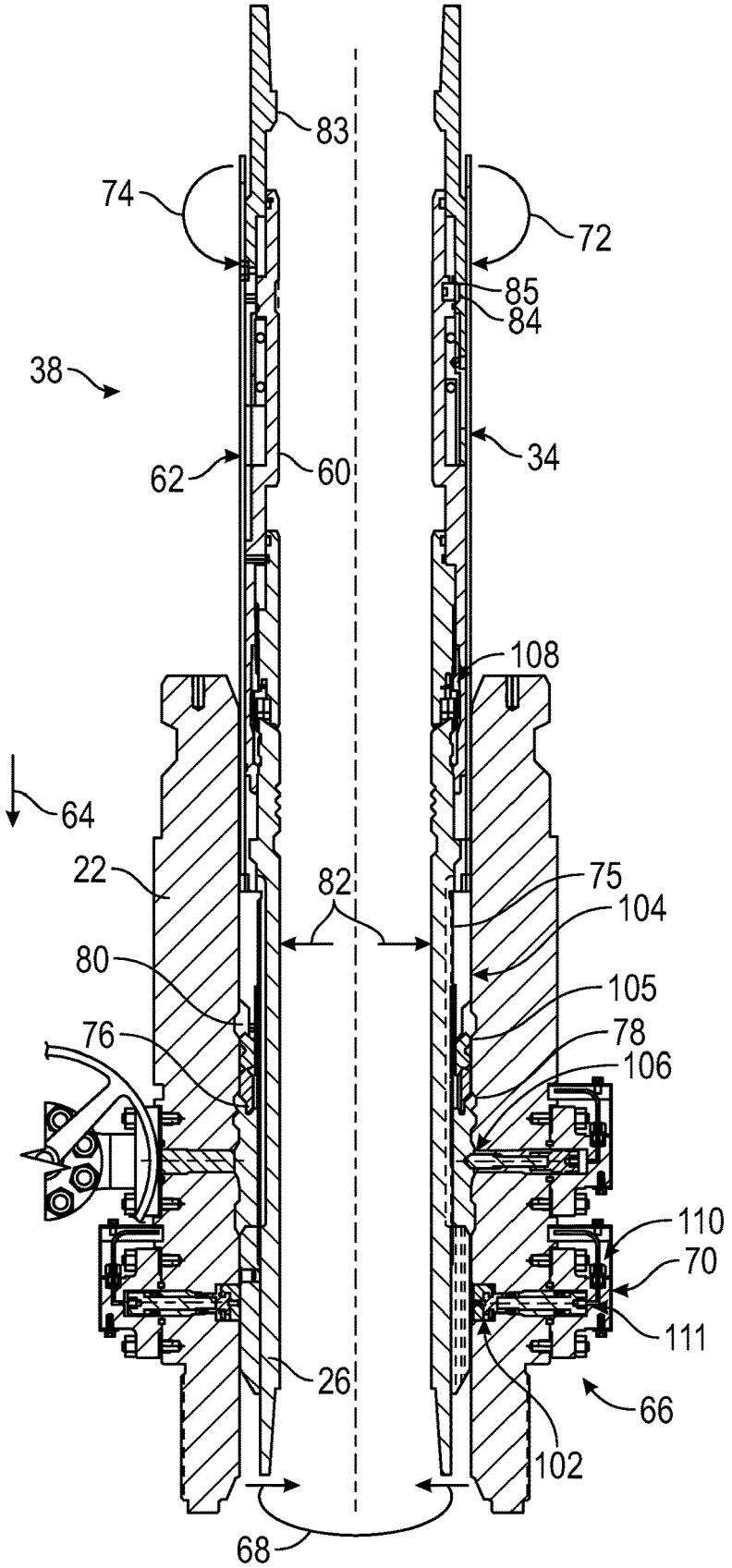
FIG. 2 is a cross-sectional illustration of an example of a running tool and a hanger deployed in a casing spool of a wellhead, according to an embodiment of the disclosure.

Referring generally to FIG. 2, a cross-sectional illustration of an example of running tool system 38 is illustrated as coupled with hanger 26. The running tool system 38 is employed for lowering and setting the hanger 26 in the wellhead 14, e.g. in the casing spool 22. As illustrated, the running tool 34 comprises an inner sleeve 60 and an outer sleeve 62. The inner sleeve 60 is coupled to and supports the hanger 26 while the outer sleeve 62 is coupled to an adjustable landing ring 104. By way of example, the inner sleeve 60 (and thus running tool 34) may be releasably coupled to hanger 26 via a coupling mechanism 108, e.g. a threaded engagement region, a collet mechanism, or another suitable coupling mechanism. In operation, the string 36 is used to lower the running tool 34 which, in turn, lowers the hanger 26 in the direction indicated by arrow 64. The hanger 26 may be lowered until the hanger 26 aligns with a hanger suspension system 66. The hanger suspension system 66 may comprise casing slips 102 which are coupled to corresponding pistons 111.

During a hanger suspension operation, the pistons 111 are driven radially inward in the direction indicated by arrows 68. The pistons 111 may be shifted via an actuator 70 until the casing slips 102 are coupled with and suspend the hanger 26 within the casing spool 22. The casing slips 102 may thus be used to grip the hanger 26 until it is more permanently secured in the wellhead 14 as described in greater detail below. The actuator 70 may be a hydraulic actuator, electric actuator, manual actuator, combinations of actuators, or another type of suitable actuator or actuators. In some embodiments, the actuator 70 may be in the form of a hydraulic actuator which receives hydraulic actuating fluid via ports 110.

The running tool 34 may be used to deploy the hanger 26 into the casing spool 22. However, after coupling the hanger 26 with the casing slips 102, the running tool 34 may be relaxed, e.g. tension on string 36 may be released or reduced. At this stage, the running tool 34 may be rotated to energize the adjustable landing ring 104. By releasing tension on the running tool 34, the running tool system 38 may reduce strain between hanger 26 and the adjustable landing ring 104. This, in turn, is able to facilitate coupling of the hanger 26 to the casing spool 22, e.g. via rotation of the adjustable landing ring 104.

Figure 3:
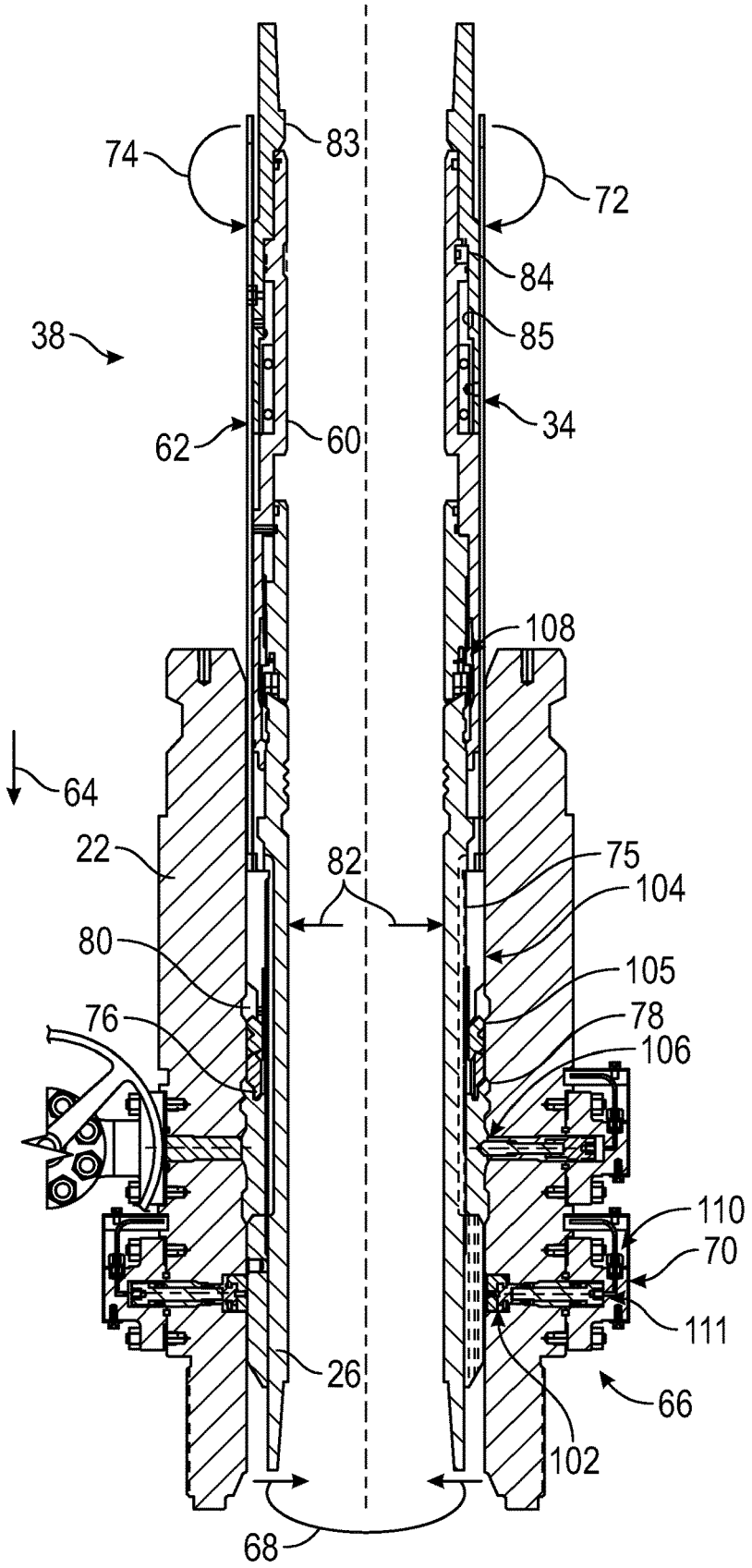
FIG. 3 is a cross-sectional illustration similar to that of FIG. 2 but showing the running tool and hanger in a different operational position, according to an embodiment of the disclosure.

In operation, the outer sleeve 62 is releasably coupled with and rotates the adjustable landing ring 104 to cause engagement of a split load ring 105 to the casing spool 22. It should be noted that once casing slips 102 are engaged with, e.g. biting into, hanger 26 an upper joint 83 of the running tool 34 may be lowered relative to inner sleeve 60 to depress a dog 84, as illustrated in FIG. 3, such that the dog 84 is released from the corresponding recess 85. Release of dog 84 effectively releases the outer sleeve 62 from the inner sleeve 60 and this allows the upper joint 83 and the outer sleeve 62 to freely rotate together relative to hanger 26. As the upper joint 83 and outer sleeve 62 are rotated in direction 72, they are able to wind down landing ring 104 so as to shift split load ring 105 for engagement with casing spool 22.

For example, rotation of the outer sleeve 62 via running tool 34 in direction 72 causes the outer sleeve 62 to rotate the adjustable landing ring 104 about the hanger 26. In the example illustrated, the adjustable landing ring 104 is threadably engaged with the hanger 26 via threads 75. Thus, rotation of the adjustable landing ring 104 with respect to hanger 26 causes it to move in direction 64.

As the adjustable landing ring 104 moves axially in direction 64 (due to rotation by sleeve 62), the adjustable landing ring 104 drives a contact or support ring 76 in direction 64. In some embodiments, the support ring 76 may be releasably coupled with adjustable landing ring 104 via a shear member 80, e.g. a shear pin. The contact or support ring 76 supports the split load ring 105 which is configured to engage a profile, e.g. a groove, 78 located on an interior surface of the casing spool 22 or other suitable portion of wellhead 14. As the outer sleeve 62 continues to rotate the landing ring 104, the contactor support ring 76 continues to move in direction 64 until it engages a plug 106.

The plug 106 stops further axial movement of the support ring 76 in direction 64 so as to axially align the split load ring 105 with the groove 78. As the running tool 34 continues to rotate, the rotating outer sleeve 62 causes the adjustable landing ring 104 to shear through the shear pin 80 which couples support ring 76 to the adjustable landing ring 104. The adjustable landing ring 104 is then able to continue rotating independently of the support ring 76. As the adjustable landing ring 104 continues to be rotated, the adjustable landing ring 104 slides under the split load ring 105 and drives the split load ring 105 radially outward in the direction represented by arrows 82. As the split load ring 105 moves radially outward in direction 82, the split load ring 105 engages the groove 78, thus coupling the hanger 26 to the casing spool 22 (see FIG. 5).

Figure 4:
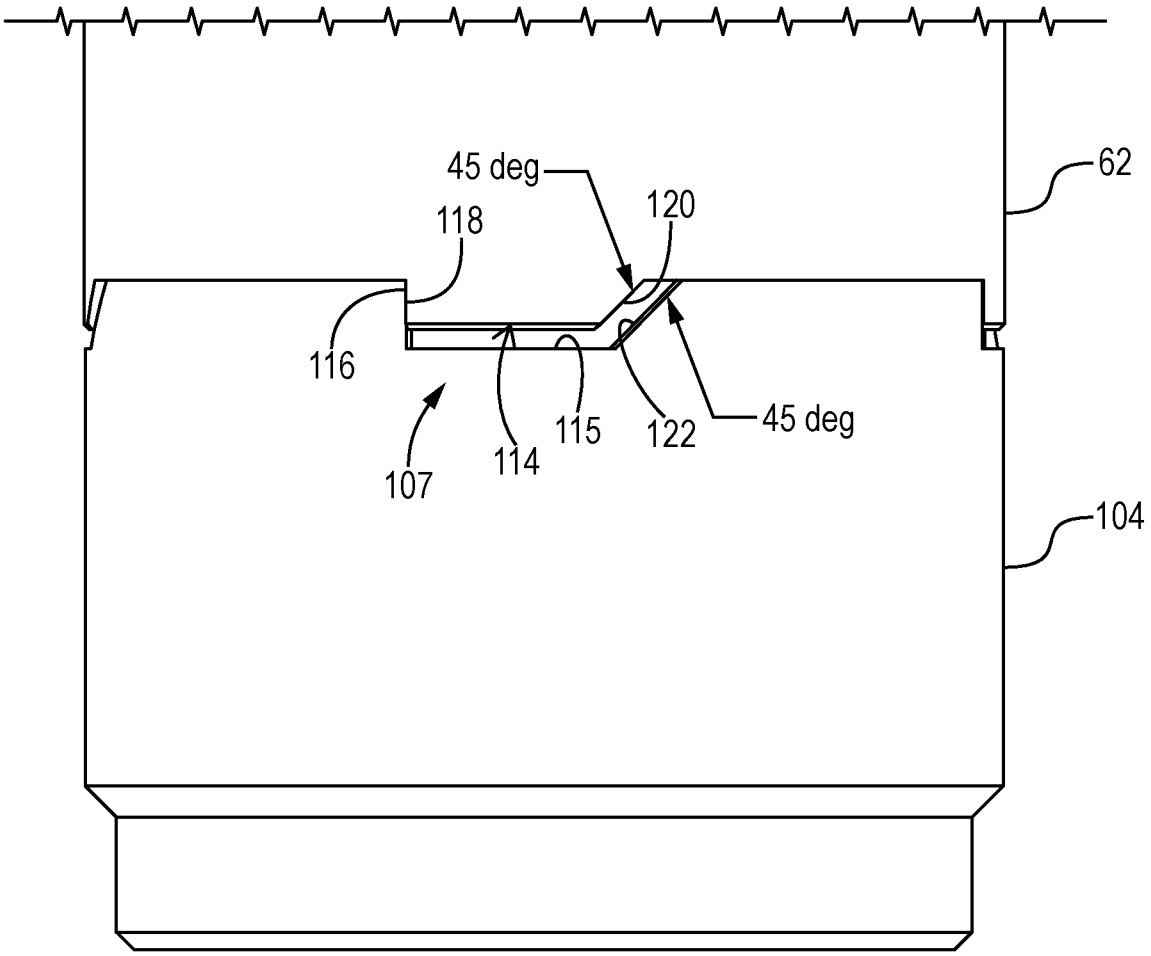
FIG. 4 is a schematic illustration showing an example of a castellation coupling between an outer sleeve and a corresponding upper joint of the running tool, according to an embodiment of the disclosure.

Because upper joint 83 and outer sleeve 62 are coupled together and rotate together, the outer sleeve 62 may be coupled with adjustable landing ring 104 via a castellation 107 (or other suitable structure) as further illustrated in FIG. 4. In this example, the outer sleeve 62 comprises a castellation member 114 received in a corresponding recess 115 formed in, for example, an upper edge of adjustable landing ring 104. It should be noted, the number of castellation members 114 and recesses 115 may vary.

As illustrated, the castellation member 114 comprises an abutment edge 116, e.g. a right angle edge, which engages a corresponding abutment edge 118 in recess 115 of adjustable landing ring 104. The abutment edge 116 and corresponding abutment edge 118 allow the outer sleeve 62 to force rotation of adjustable landing ring 104 in a desired direction, e.g. direction 72. However, the castellation member 114 also comprises a sloped edge 120, e.g. a 45° angle edge, opposite abutment edge 116. The sloped edge 120 is oriented to engage a corresponding sloped edge 122 disposed appropriately in recess 115 of adjustable landing ring 104.

Thus, when upper joint 83 is rotated together with outer sleeve 62 in the opposite direction, e.g. direction 74, the outer sleeve 62 will not rotate adjustable landing ring 104 due to the engagement of sloped edge 120 and corresponding sloped edge 122. As the upper joint 83 and outer sleeve 62 are rotated in direction 74, the sloped edges 120, 122 cause the outer sleeve 62 to slide up and out of recess 116 to enable rotation of outer sleeve 62 with respect to adjustable landing ring 104. By way of example, the upper joint 83 and outer sleeve 62 may be rotated in direction 74 to release coupling mechanism 108 during, for example, retrieval of casing hanger running tool 34 from casing hanger 26. In other words, the upper joint 83 and outer sleeve 62 may be rotated in direction 74 freely so as to fully unthread the casing hanger running tool 34 from the hanger 26 (at least in embodiments using a threaded engagement between tool 34 and hanger 26). This allows retrieval of the running tool 34, as illustrated in FIG. 5.

Figure 5:
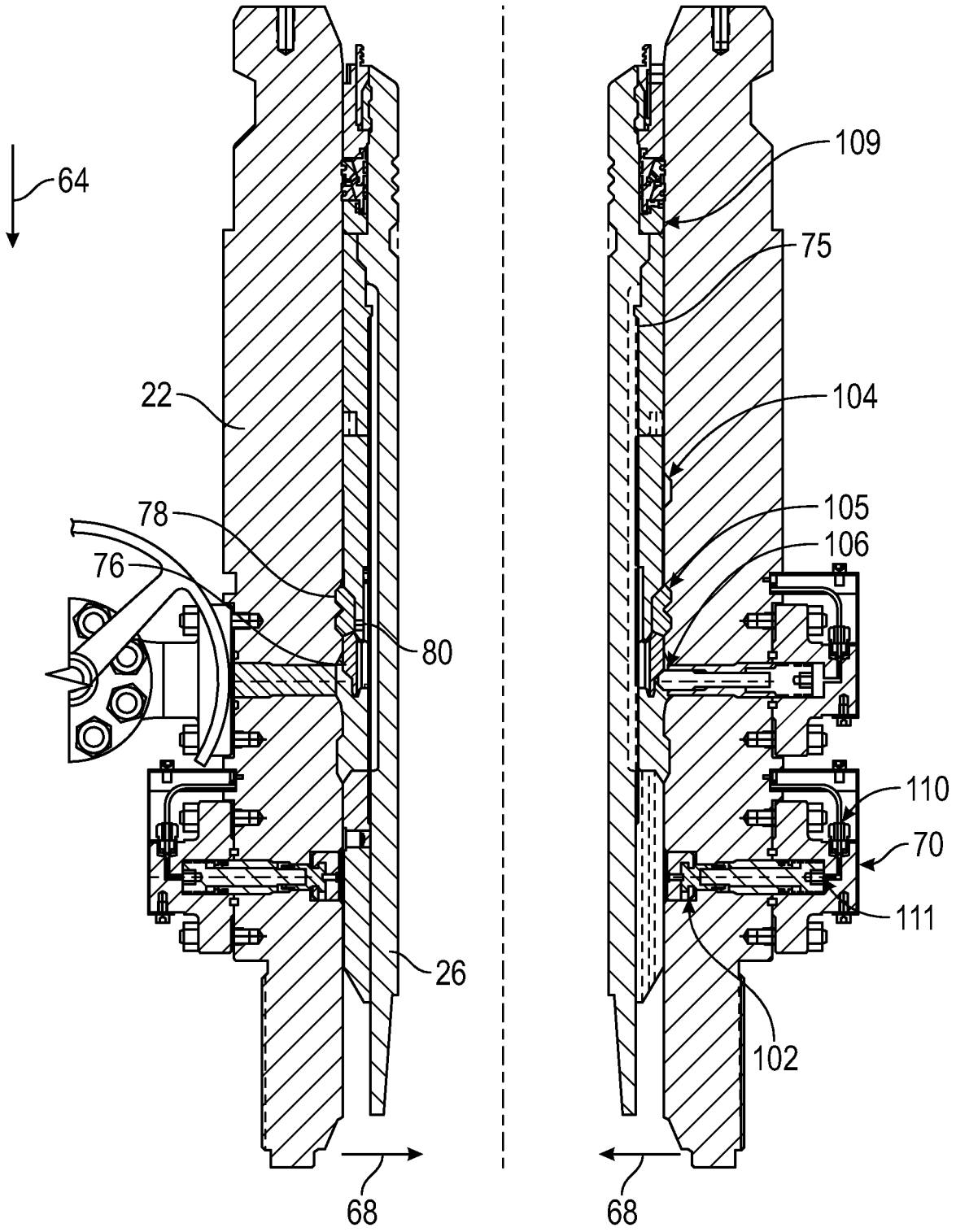
FIG. 5 is a cross-sectional illustration of the hanger illustrated in FIG. 2 after deployment and after removal of the running tool, according to an embodiment of the disclosure.

In FIG. 5, a cross-sectional view is provided which shows hanger 26 coupled to the casing spool 22 after removal of running tool 34. As illustrated, the split load ring 105 rests within the groove 78. The adjustable landing ring 104 blocks retraction of the split load ring 105 out of the groove 78 in direction 68. It should be noted that once the hanger 26 is coupled with the casing spool 22, the actuator 70 may be operated to retract the pistons 111, thus enabling disengagement of the casing slips 102 from the hanger 26. Likewise, the running tool 34 may be disengaged from the hanger 26 as described above. After the running tool 34 is disengaged from the hanger 26 and removed, another tool may be used to run and install components, e.g. a seal system 109 between the casing spool 22 and the hanger 26.

Depending on the parameters of a given application, various components may be adjusted, interchanged, or added. For example, running tool 34 may be mounted on a variety of strings 36 and may comprise a variety of features for coupling with and actuating components of hanger 26 and/or other tools. Similarly, the hanger 26 may be used for hanging a variety of tubular members and may have a variety of features to accommodate setting and use of the hanger. The hanger 26 also may be used in many types of wellheads 14 having various components and features. The sizes and configurations of components and features also may be selected according to the structural parameters and operating parameters of a given downhole operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a running tool and hanger system, comprising:

a running tool configured for coupling with a hanger, the running tool having:

a first sleeve configured to couple to and move the hanger in an axial direction; and a second sleeve configured to couple to an adjustable landing ring surrounding the hanger, the second sleeve being configured to rotate the adjustable landing ring to lock the hanger in position;

a hanger suspension system configured to couple to and suspend the hanger as the running tool rotates and adjusts the position of the adjustable landing ring; and a support ring releasably coupled to the adjustable landing ring, the support ring supporting a load ring.

2. The system as recited in claim 1, wherein the running tool further comprises an upper joint connected to the second sleeve.

3. The system as recited in claim 2, wherein the second sleeve is an outer sleeve relative to the first sleeve.

4. The system as recited in claim 1, wherein the load ring is oriented for movement, via the adjustable landing ring, into engagement with a profile located on an interior surface of a casing spool.

5. The system as recited in claim 4, wherein the support ring is moved in an axial direction by the adjustable landing ring until contacting a plug so as to ensure alignment of the load ring with the profile.

6. The system as recited in claim 1, wherein the support ring is releasably coupled to the adjustable landing ring by a shear member.

7. The system as recited in claim 1, wherein the hanger suspension system comprises slips coupled to corresponding pistons, the slips being oriented to engage the hanger.

8. The system as recited in claim 7, wherein the corresponding pistons are hydraulically actuated.

9. A system for use in a well application, comprising:

a hanger;

a running tool constructed for releasable engagement with the hanger, the running tool having an inner sleeve, coupled to the hanger during deployment of the hanger into a wellhead, and an outer sleeve which may be rotated relative to the hanger to force a load ring into engagement with the wellhead so as to support the hanger in the wellhead; wherein the load ring is forced into engagement with the wellhead via rotation of an adjustable landing ring which is threadably mounted on the hanger; and is supported by a support ring initially coupled to the adjustable landing ring by a shear member.

10. The system as recited in claim 9, wherein the load ring is forced into a profile located along an interior surface of a casing spool of the wellhead.

11. The system as recited in claim 9, wherein the running tool further comprises an upper joint connected to the outer sleeve for rotation with the outer sleeve.

12. The system as recited in claim 11, wherein the combined upper joint and outer sleeve are initially coupled to the inner sleeve via a dog received in a recess.

13. The system as recited in claim 9, further comprising a hanger suspension system to initially support the hanger while the outer sleeve is rotated to force the load ring into engagement with the wellhead.

* * * * *